US008967170B1

(12) United States Patent
Lai

(10) Patent No.: US 8,967,170 B1
(45) Date of Patent: Mar. 3, 2015

(54) ADJUSTABLE POSITIONING STRUCTURE FOR A WALKING STICK

(71) Applicant: Valor Enterprise Co., Ltd., Chang Hua (TW)

(72) Inventor: Hsiu-Chen Lai, Chang Hua (TW)

(73) Assignee: Valor Enterprise Co., Ltd., Chang Hua (TW)

( * ) Notice: Subject to any disclaimer, the term of this patent is extended or adjusted under 35 U.S.C. 154(b) by 0 days.

(21) Appl. No.: 14/082,240

(22) Filed: Nov. 18, 2013

(51) Int. Cl.
*A45B 9/00* (2006.01)

(52) U.S. Cl.
CPC ..... *A45B 9/00* (2013.01)
USPC ..... 135/75

(58) Field of Classification Search
CPC .... A45B 9/00; A45B 2009/007; F16B 7/1463
USPC ..... 135/69, 75, 70; 403/109.5, 109.7
See application file for complete search history.

(56) References Cited

U.S. PATENT DOCUMENTS 2,090,550 A * 8/1937 Pilblad ..... 248/410
4,706,916 A * 11/1987 Cullmann et al. ..... 248/168
6,007,268 A * 12/1999 Whittington et al. ..... 403/328
6,250,839 B1 * 6/2001 Lenhart ..... 403/109.5
6,273,112 B1 * 8/2001 Sumida ..... 135/75
7,302,745 B2 * 12/2007 Stahle ..... 29/434
7,845,602 B1 * 12/2010 Young et al. ..... 248/125.8
8,215,863 B2 * 7/2012 Sohn ..... 403/109.5
8,418,707 B2 * 4/2013 Kim ..... 135/75
8,479,932 B2 * 7/2013 Carney ..... 211/105.5

FOREIGN PATENT DOCUMENTS

GB 2200402 B * 12/1990
GB 2241995 A * 9/1991 ..... F16B 7/14

* cited by examiner

*Primary Examiner* — Noah Chandler Hawk
(74) *Attorney, Agent, or Firm* — Alan D. Kamrath; Kamrath IP Lawfirm, P.A.

(57) ABSTRACT

An adjustable positioning structure for a walking stick contains an outer rod, an inner rod, an actuation post, a pushing, and an expending member. The outer rod includes a griping head, a limiting sleeve with shoulder, and a first screwing section. The inner rod includes an anti-slip pad, a flange, and a slot. The actuation post includes a second screwing section, a bushing with a through hole, a holding sheath, a bolt, and a stopping piece. The pushing member includes a conical face defined thereon, a second end inserted into the inner rod, an orifice, and a spring being biased against the pushing member and the stopping piece. The expending member includes an aperture, a nut, a plurality of expansion sheets vertically extending around an outer wall thereof and surrounding around the actuation post, and a resilient loop fitted on a distal end thereof.

6 Claims, 14 Drawing Sheets

ADJUSTABLE POSITIONING STRUCTURE FOR A WALKING STICK

FIELD OF THE INVENTION

The present invent relates to a walking stick, and more particularly to an adjustable positioning structure for a walking stick which is used to adjust a length of the walking stick easily.

BACKGROUND OF THE INVENTION

With reference to FIGS. 13 and 14, a conventional walking stick 60 contains a first rod 61, a second rod 62, and an adjustable position structure 70 defined between the first rod 61 and the second rod 62. The adjustable positioning structure 70 includes a fitting post 71 and an expanding member 72. The fitting post 71 is inserted into and retained with the second rod 62 and has an external screwing section 711 formed around an outer wall thereof, and the expending member 72 is screwed with the external screwing section 711 of the fitting post 71 and has a resilient retaining paw 721 fixed on a bottom end thereof. In addition, the fitting post 71 is further fitted into a conical holder 80 and has a support portion 712 for contacting with the conical holder 80, wherein the conical holder 80 is obliquely biased against the resilient retaining paw 721, such that the resilient retaining paw 721 of the expending member 72 expends outwardly to engage with an inner wall of the first rod 61. As desiring to adjust a length of the walking stick 60, the second rod 63 is rotated by a user so as to drive the fitting post 71 and the conical holder 80 to rotate, and the external screwing section 711 of the fitting post 71 and the expending member 72 are also driven to rotate, such that the expending member 72 engages with or disengage from the conical holder 80, thus adjusting the length of the walking stick.

However, such a conventional walking stick has the following disadvantages:

1. The expending member 80 is expended by the conical holder 80 after rotating the fitting post 71, such that the resilient retaining paw 721 of the expending member 72 engages with the inner wall of the first rod 61. As the user intends to engage the retaining paw 721 of the expending member 72 with the inner wall of the first rod 61 more tightly, more force is exerted on the fitting post 71 by the user so that the fitting post 71 presses the expending member 72 forcefully, thus causing a laborious operation. Moreover, when exerting weight on the first rod 61, the expending member 72 engages with the external screwing section 711 of the fitting post 71 overly, hence an operation of the expending member 71 and the fitting post 71 is stuck.

2. The external screwing section 711 of the fitting post 71 and the expending member 72 are rotated to adjust the length of the walking stick, and an outer surface of the second rod 62 is too smooth to grip the second rod 62 securely. Furthermore, the length of the walking stick is adjusted slowly and troublesomely by rotating the second rod 62.

3. The resilient retaining paw 721 is made of plastic material and is applied to engage with the inner wall of the first rod 61, so a friction resistance between resilient retaining paw 721 and the inner wall of the first rod 61 is small, the resilient retaining paw 721 cannot engage with the inner wall of the first rod 61 securely.

The present invention has arisen to mitigate and/or obviate the afore-described disadvantages.

SUMMARY OF THE INVENTION

The primary object of the present invention is to provide an adjustable positioning structure for a walking stick which is used to adjust a length of the walking stick easily.

Further object of the present invention is to provide an adjustable positioning structure for a walking stick by which a friction resistance between a first screwing section and a resilient loop is increased to enhance support safety.

Another object of the present invention is to provide an adjustable positioning structure for a walking stick which positions the walking stick securely.

To obtain the above objective, an adjustable positioning structure for a walking stick provided by the present invention contains: an outer rod, an inner rod, an actuation post, a pushing, and an expending member.

The outer rod includes a griping head disposed on a first end thereof and a limiting sleeve mounted on a second end thereof, the limiting sleeve has a shoulder formed on an inner wall thereof, and the outer rod also includes a first screwing section defined around an inner wall thereof.

The inner rod includes an anti-slip pad fixed on a first end thereof and a flange formed around a second end thereof, and the second end of the inner rod is inserted into the outer rod, such that the flange is limited by the shoulder of the limiting sleeve. The inner rod also includes a slot passing through a middle section thereof.

The actuation post includes a second screwing section defined around a first end thereof and a bushing fitted on a second end thereof. The bushing has a through hole horizontally formed therein, wherein the second screwing section of the actuation post is inserted into the outer rod, and the bushing is inserted into the inner rod. The actuation post also includes a holding sheath fitted on the inner rod and a bolt inserted through the holding sheath, the slot of the inner rod, and the through hole of the bushing. The actuation post further includes a stopping piece fixed on a middle section thereof.

The pushing member includes a conical face defined on a first end thereof, a second end inserted into the inner rod, an orifice formed thereon so as to inert the second screwing section of the actuation post, and a spring being biased against the pushing member and the stopping piece.

The expending member includes an aperture for fitting the expending member with the first end of the actuation post, a nut for screwing with the second screwing section so as to limit the expending member and the pushing member, a plurality of expansion sheets vertically extending around an outer wall thereof and surrounding around the actuation post, and a resilient loop fitted on a distal end thereof, such that the conical face of the pushing member pushes the plurality of expansion sheets to force the resilient loop, and then the resilient loop is biased against the first screwing section of the outer rod, thereby fixing the outer rod and the inner rod securely.

DETAILED DESCRIPTION OF THE PREFERRED EMBODIMENTS

Figure 1:
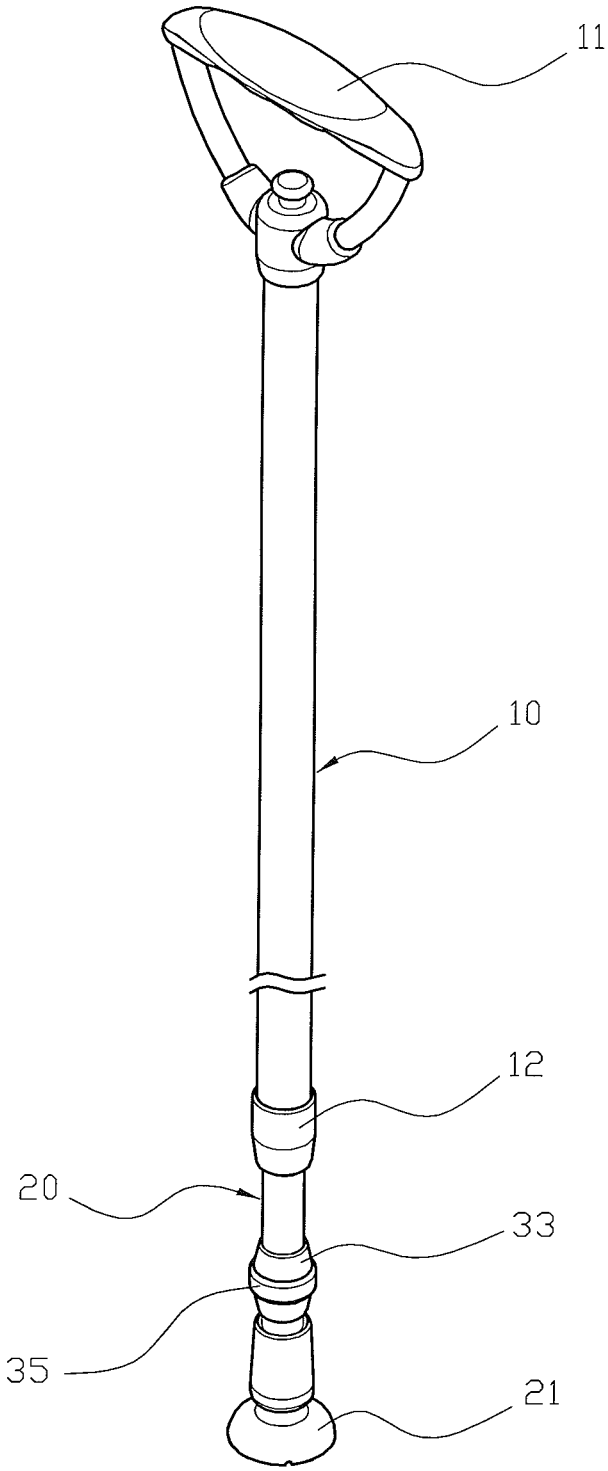
FIG. 1 is a perspective view showing the assembly of an adjustable positioning structure for a walking stick according to a preferred embodiment of the present invention.
Figure 2:
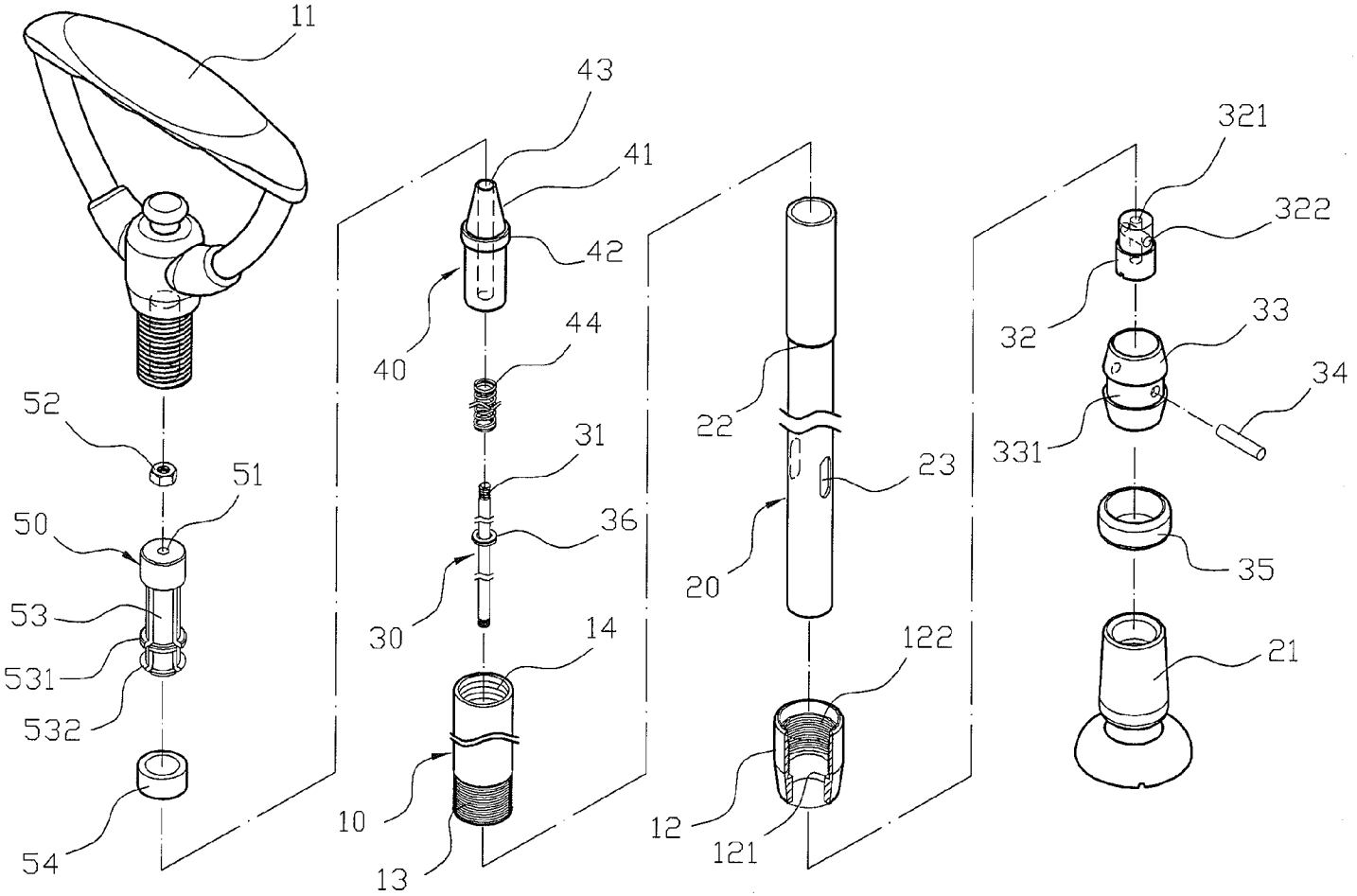
FIG. 2 is a perspective view showing the exploded components of the adjustable positioning structure for the walking stick according to the preferred embodiment of the present invention.

With reference to FIGS. 1 and 2, an adjustable positioning structure for a walking stick comprises an outer rod 10, an inner rod 20, a driving shaft 30, and a pushing member 40. The outer rod 10 includes a griping head 11 disposed on a first end thereof and a limiting sleeve 12 mounted on a second end thereof, the limiting sleeve 12 has a shoulder 121 formed on an inner wall thereof and inner threads 122 above the shoulder 12. The outer rod 10 also includes outer threads 13 arranged around an outer wall thereof so as to screw with the inner threads 122 of the limiting sleeve 12 and includes a first screwing section 14 defined around an inner wall thereof. The inner rod 20 includes an anti-slip pad 21 fixed on a first end thereof so as to abut against a ground and includes a flange 22 formed around a second end thereof, wherein the second end of the inner rod 20 is inserted into the outer rod 10, such that the flange 22 is limited by the shoulder 121 of the limiting sleeve 12. The inner rod 20 also includes a slot 23 passing through a middle section thereof and an actuation post 30. The actuation post 30 includes a second screwing section 31 defined around a first end thereof and a bushing 32 fitted on a second end thereof, the bushing 32 has a screw hole 321 vertically arranged therein so as to screw with the actuation post 30 and has a through hole 322 horizontally formed therein, wherein the second screwing section 31 of the actuation post 30 is inserted into the outer rod 10, and the bushing 32 is inserted into the inner rod 20. The actuation post 30 also includes a holding sheath 33 fitted on the inner rod 20 and a bolt 34 inserted through the holding sheath 33, the slot 23 of the inner rod 20, and the through hole 322 of the bushing 32. The holding sheath 33 has a groove 331 defined thereon so as to fit with a flexible ring 35, such that the flexible ring 35 covers the bolt 34. The actuation post 30 further includes a stopping piece 36 fixed on a middle section thereof, and the pushing member 40 includes a conical face 41 defined on a first end thereof, a second end inserted into the inner rod 20, an annular rib 42 arranged around a middle section thereof and abutting against an opening of the inner tube 20, an orifice 43 formed thereon so as to inert the second screwing section 31 of the actuation post 30, and a spring 44 being biased against the pushing member 40 and the stopping piece 36. The adjustable positioning structure also comprises an expending member 50, and the expending member 50 includes an aperture 51 for fitting the expending member 50 with the first end of the actuation post 30, a nut 52 for screwing with the second screwing section 31 so as to limit the expending member 50 and the pushing member 40, a plurality of expansion sheets 53 vertically extending around an outer wall thereof and surrounding around the actuation post 30, and a resilient loop 54 fitted on a distal end thereof, wherein a first surrounding tab 531 and a second surrounding tab 532 are arranged around the plurality of expansion sheets 53 and are provided to limit the resilient loop 54, such that the conical face 41 of the pushing member 40 pushes the plurality of expansion sheets 53 to force the resilient loop 54, and then the resilient loop 54 is biased against the first screwing section 14 of the outer rod 10, thereby fixing the outer rod 10 and the inner rod 20.

Figure 3:
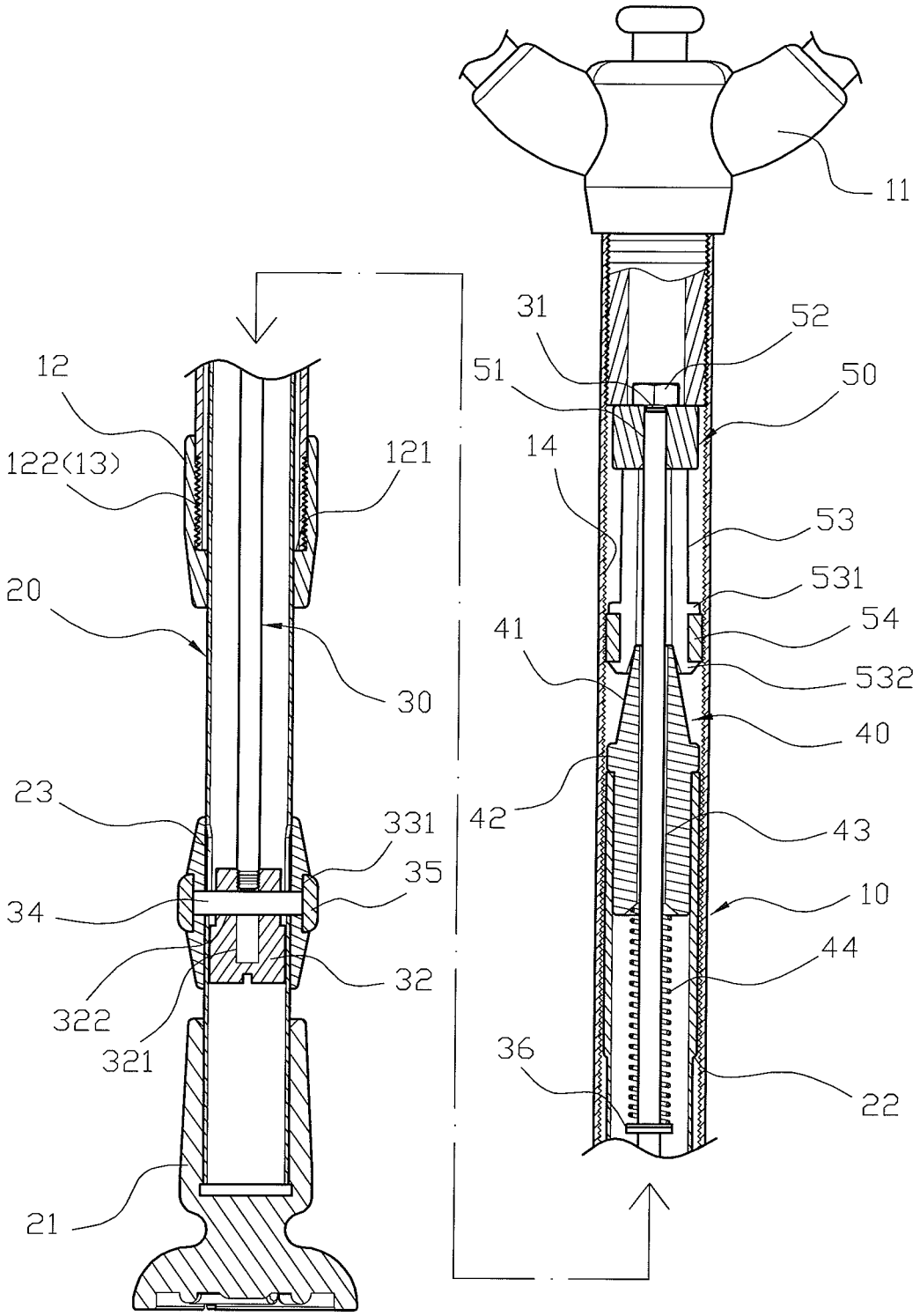
FIG. 3 is a cross sectional view showing the assembly of the adjustable positioning structure for the walking stick according to the preferred embodiment of the present invention.

Referring further to FIGS. 1-3, in assembly, the bushing 32 is screwed with the actuation post 30 by using the screw hole 321, and the through hole 322 of the bushing 32 is aligned with the slot 23 of the inner rod 20, the limiting sleeve 12 is fitted onto the inner rod 20 so that the flange 22 of the inner rod 20 is limited by the shoulder 121 of the limiting sleeve 12, thereafter the holding sheath 33 is fitted on the inner rod 20, and the bolt 34 is inserted through the holding sheath 33, the slot 23 and the through hole 322 so that the holding sheath 33 is connected with the bushing 32 and moves along the slot 23 of the inner rod 20, the flexible ring 35 is fitted with the groove 331 of the holding sheath 33, the anti-slip pad 21 is fitted with the second end of the inner rod 20, and the spring 44 is fitted into the actuation post 30 from the second end of the inner rod 20 so as to abut against the stopping piece 36. Furthermore, the pushing member 40 is fitted on the actuation post 30 by ways of the orifice 43 and pushes the inner rod 20, such that the conical face 41 of the pushing member 40 extends out of the inner rod 20, and the spring 44 abuts against the pushing member 40. The resilient loop 54 is fitted on the plurality of expansion sheets 53 of the expending member 50 and is limited by the first surrounding tab 531 and the second surrounding tab 532, the expending member 50 is fitted on the actuation post 30 by means of the aperture 51, and the nut 52 is screwed with the second screwing section 31 of the actuation post 30, thus connecting the expending member 50 with the actuation post 30. The inner rod 20 is inserted into the outer rod 10 by means of the expending member 50, and the inner threads 122 of the limiting sleeve 12 is screwed with the outer threads 13 of the outer rod 10, thus preventing the inner rod 20 from remove from the outer rod 10. Thereafter, the griping head 11 is screwed with the outer rod 10, thus assembling the walking stick completely.

Figure 4:
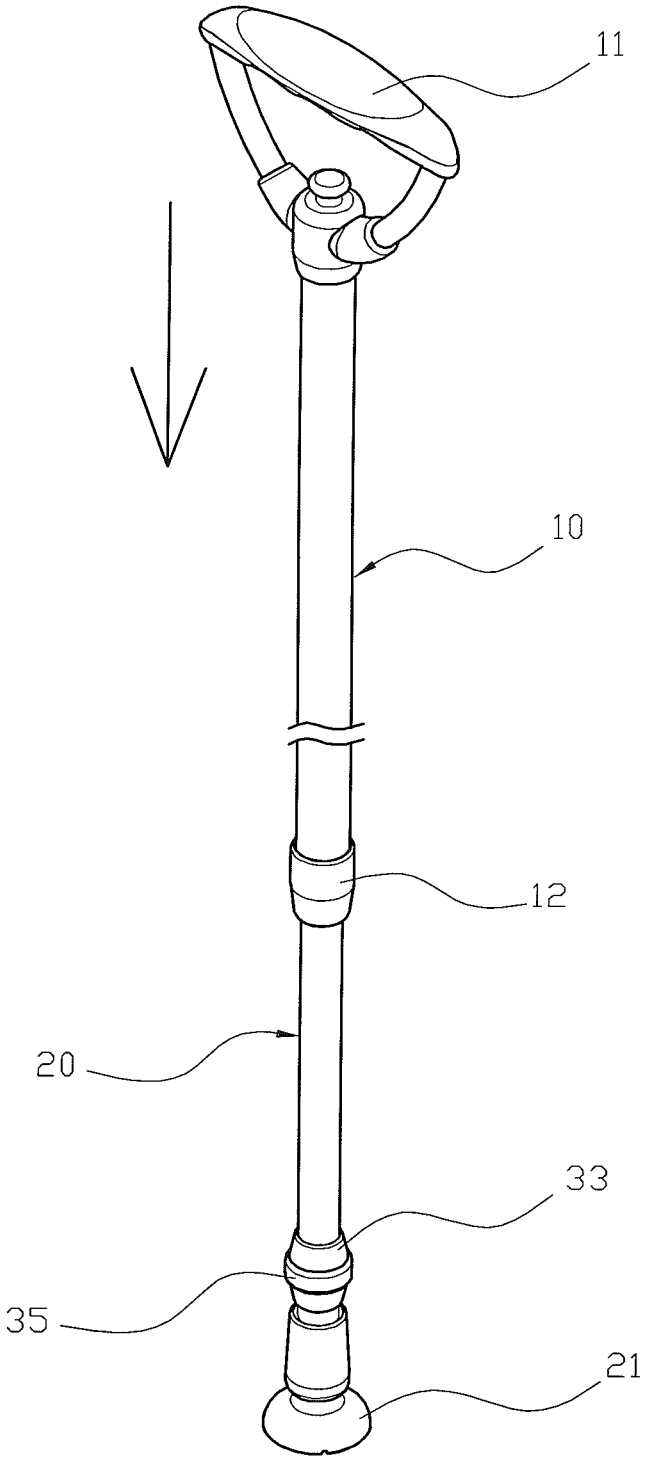
FIG. 4 is a perspective view showing the operation of the adjustable positioning structure for the walking stick according to the preferred embodiment of the present invention.
Figure 5:
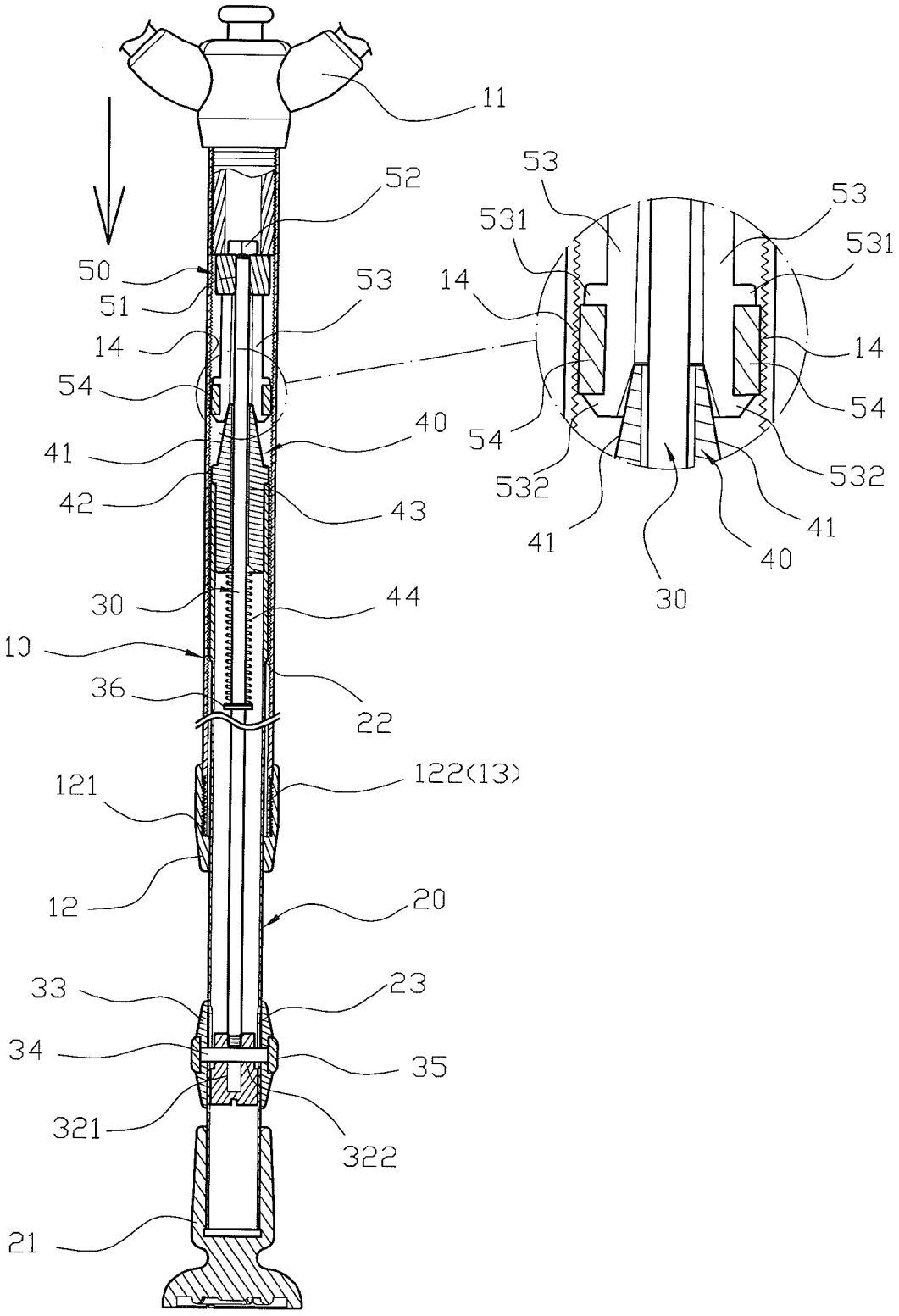
FIG. 5 is a cross sectional view showing the operation of the adjustable positioning structure for the walking stick according to the preferred embodiment of the present invention.

As shown in FIGS. 2, 4 and 5, in operation, since the spring 44 is biased against the pushing member 40 and the stopping piece 36 of the actuation post 30 so that the actuation post 30 controls the plurality of expansion sheets 53 to press the conical face 41 of the pushing member 40, such that the resilient loop 54 contacts with the first screwing section 14 of the outer rod 10, so when a user walks by using the walking stick, the griping head 11 is gripped and forced so that a gripping force is conducted to the outer rod 10. Since the resilient loop 54 of the expending member 50 contacts with the first screwing section 14 of the outer rod 10, the outer rod 10 drives the expending member 50 to press the conical face 41 of the pushing member 40, such that the pushing member 40 drives the plurality of expansion sheets 53 to extend outwardly so as to support the griping head 11, and the resilient loop 54 of the expending member 50 is expended by the plurality of expansion sheets 53 so as to contact with the first screwing section 14 of the outer rod 10 tightly. Preferably, a friction resistance between the first screwing section 14 and the resilient loop 54 is increased to enhance support safety.

Figure 6:
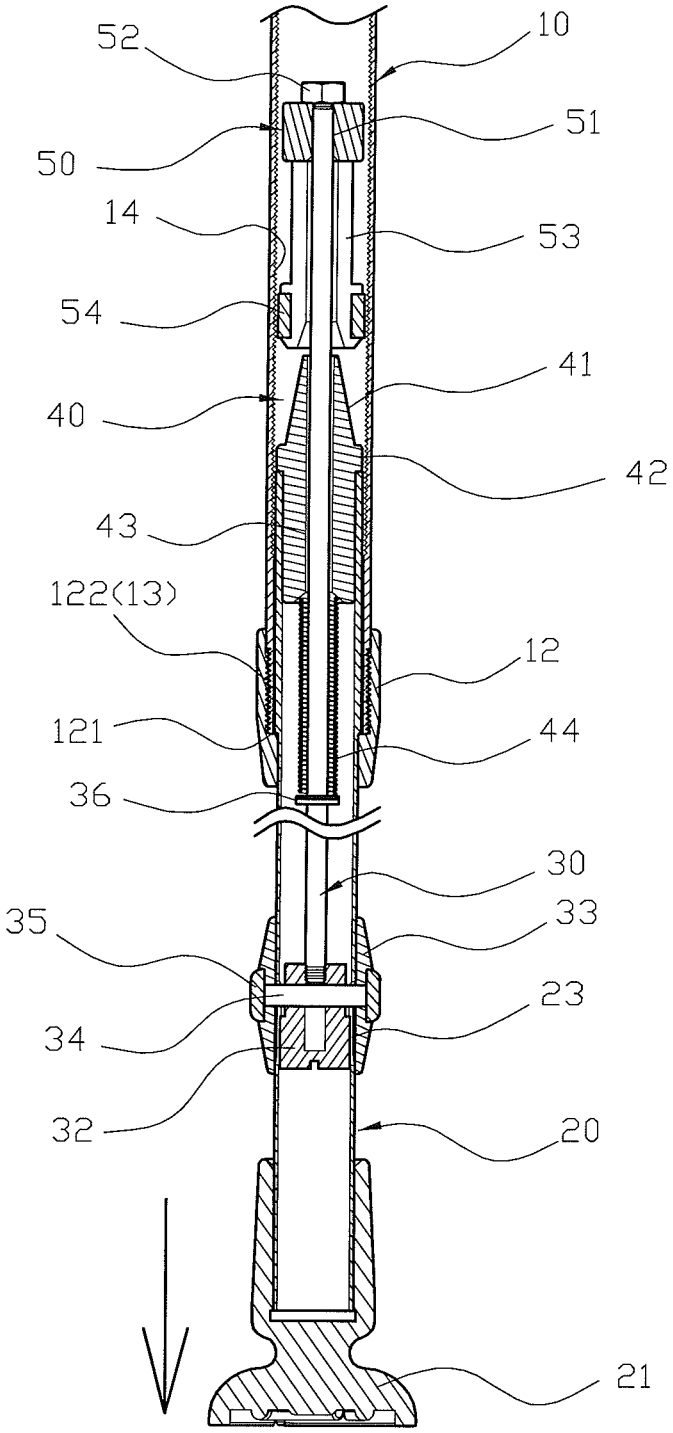
FIG. 6 is another cross sectional view showing the operation of the adjustable positioning structure for the walking stick according to the preferred embodiment of the present invention.
Figure 7:
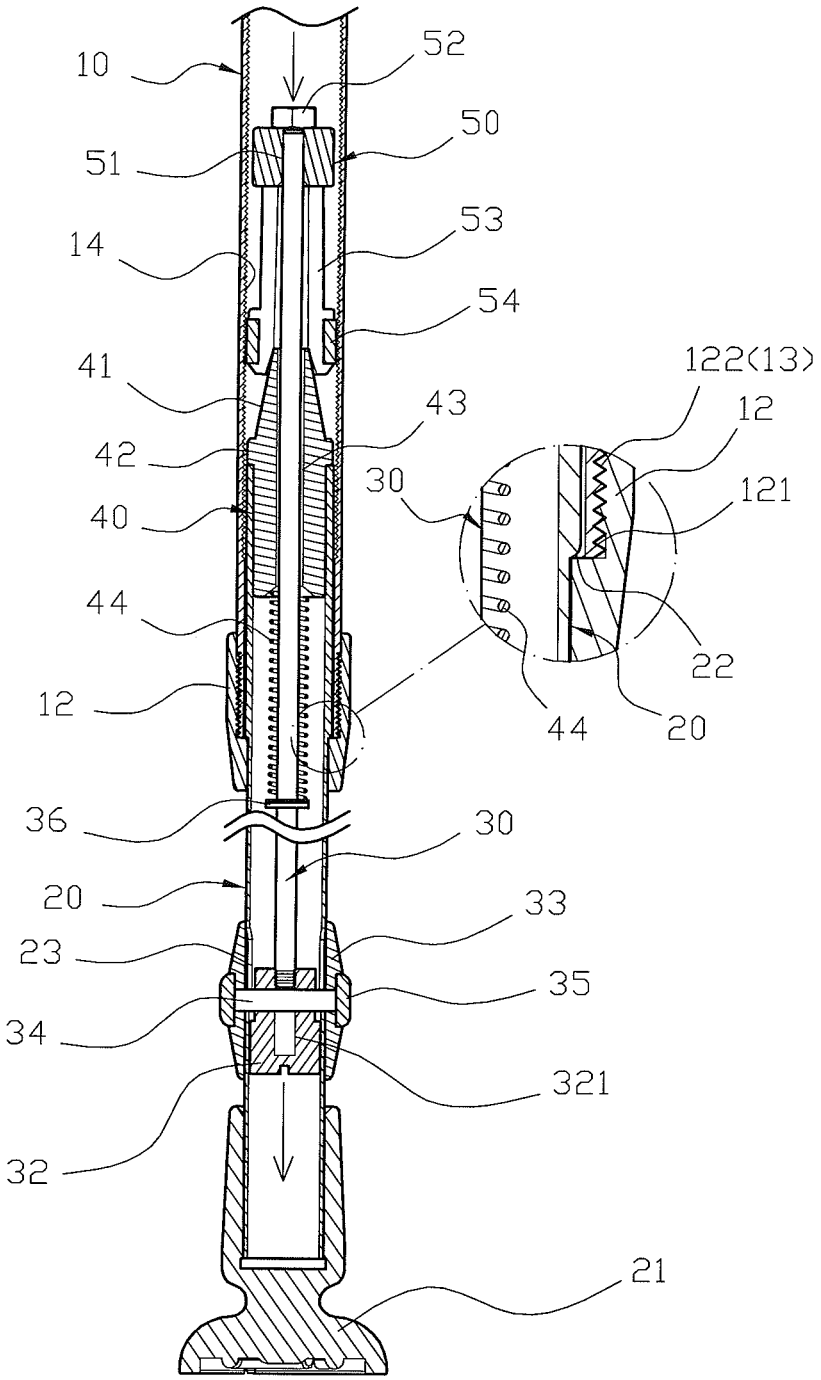
FIG. 7 is also another cross sectional view showing the operation of the adjustable positioning structure for the walking stick according to the preferred embodiment of the present invention.
Figure 8:
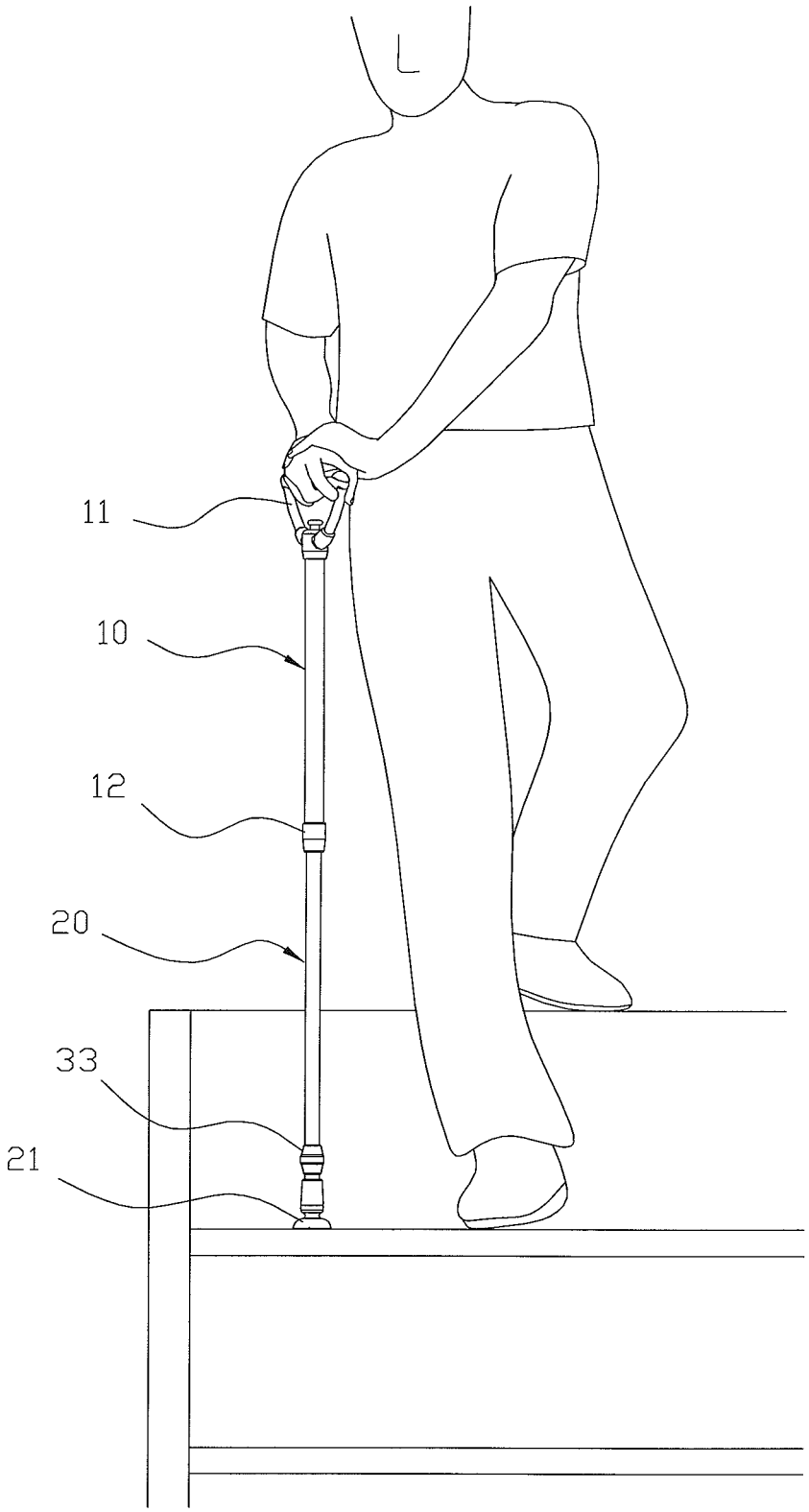
FIG. 8 is a diagram showing the application of the adjustable positioning structure for the walking stick according to the preferred embodiment of the present invention.
Figure 9:
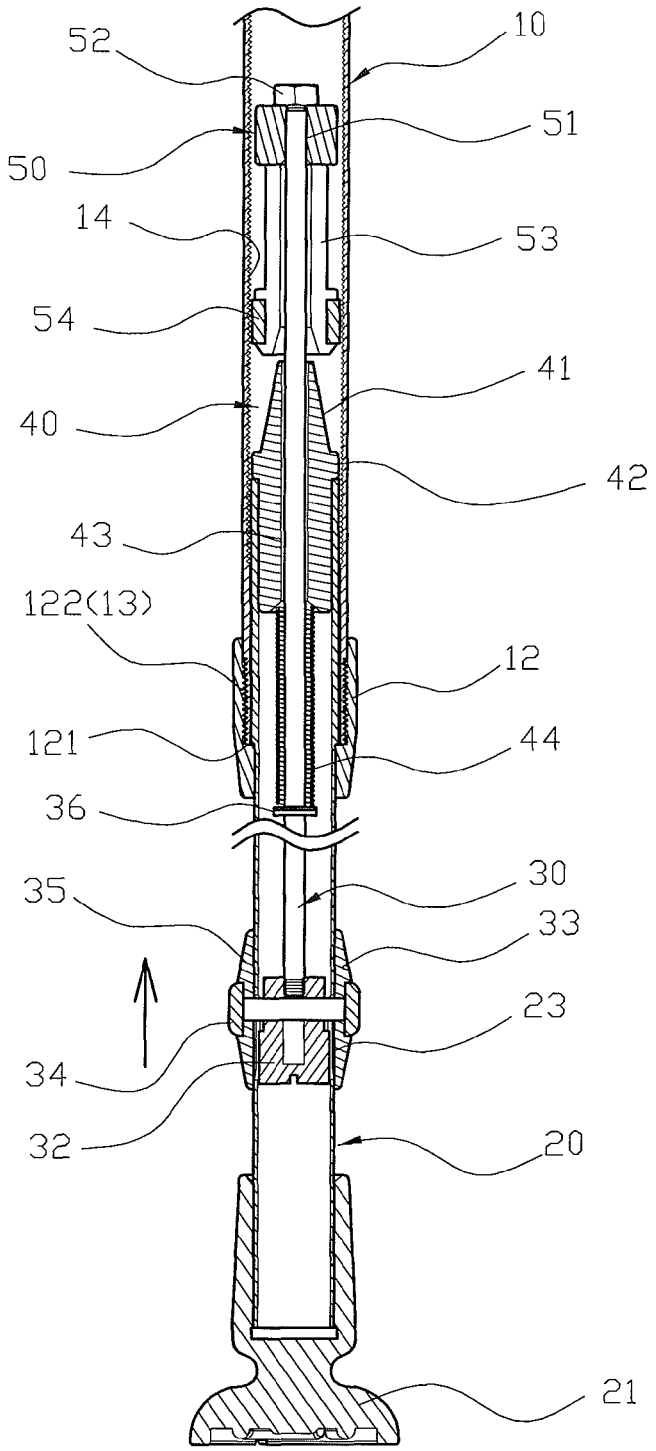
FIG. 9 is still another cross sectional view showing the operation of the adjustable positioning structure for the walking stick according to the preferred embodiment of the present invention.
Figure 10:
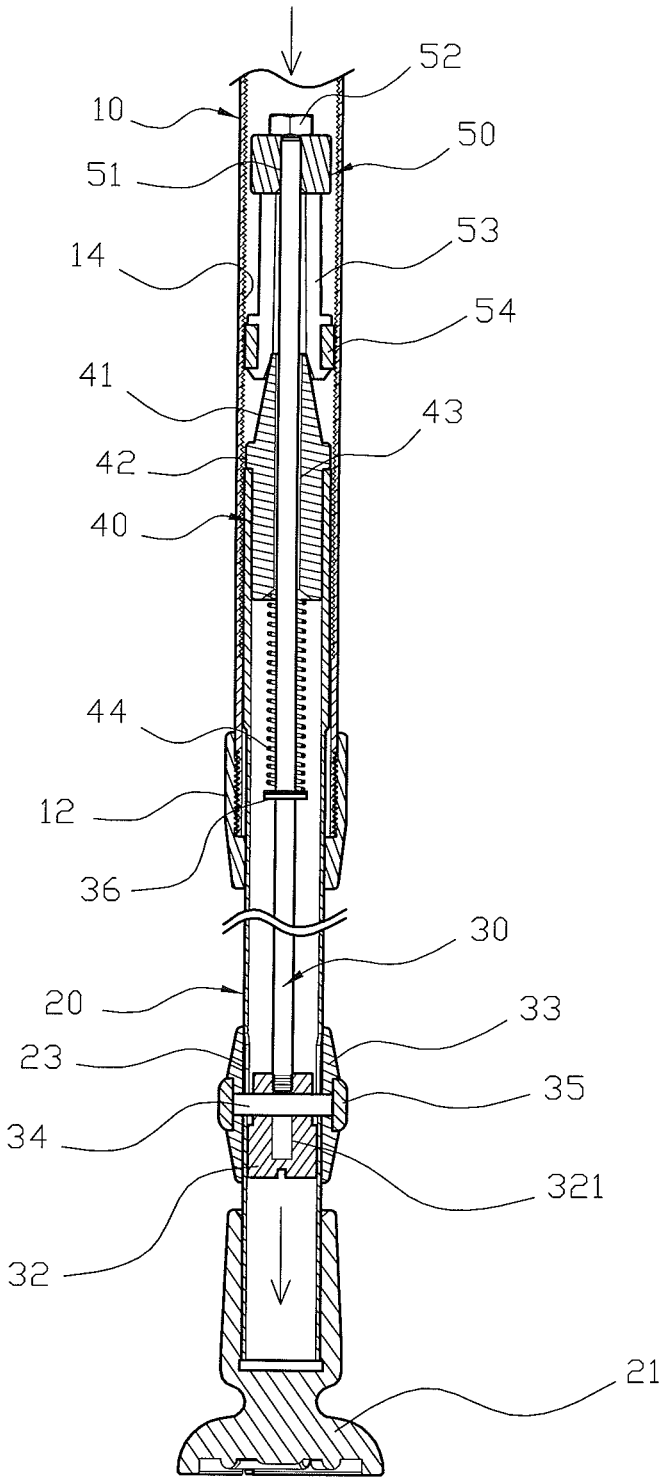
FIG. 10 is another cross sectional view showing the operation of the adjustable positioning structure for the walking stick according to the preferred embodiment of the present invention.
Figure 11:
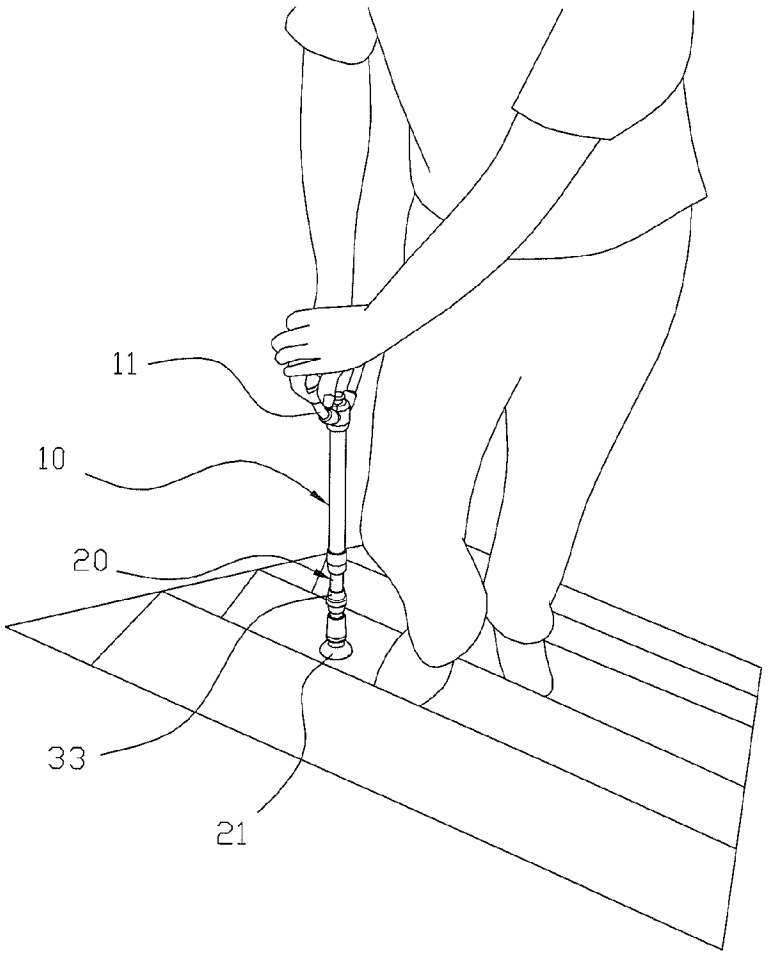
FIG. 11 is another diagram showing the application of the adjustable positioning structure for the walking stick according to the preferred embodiment of the present invention.
Figure 12:
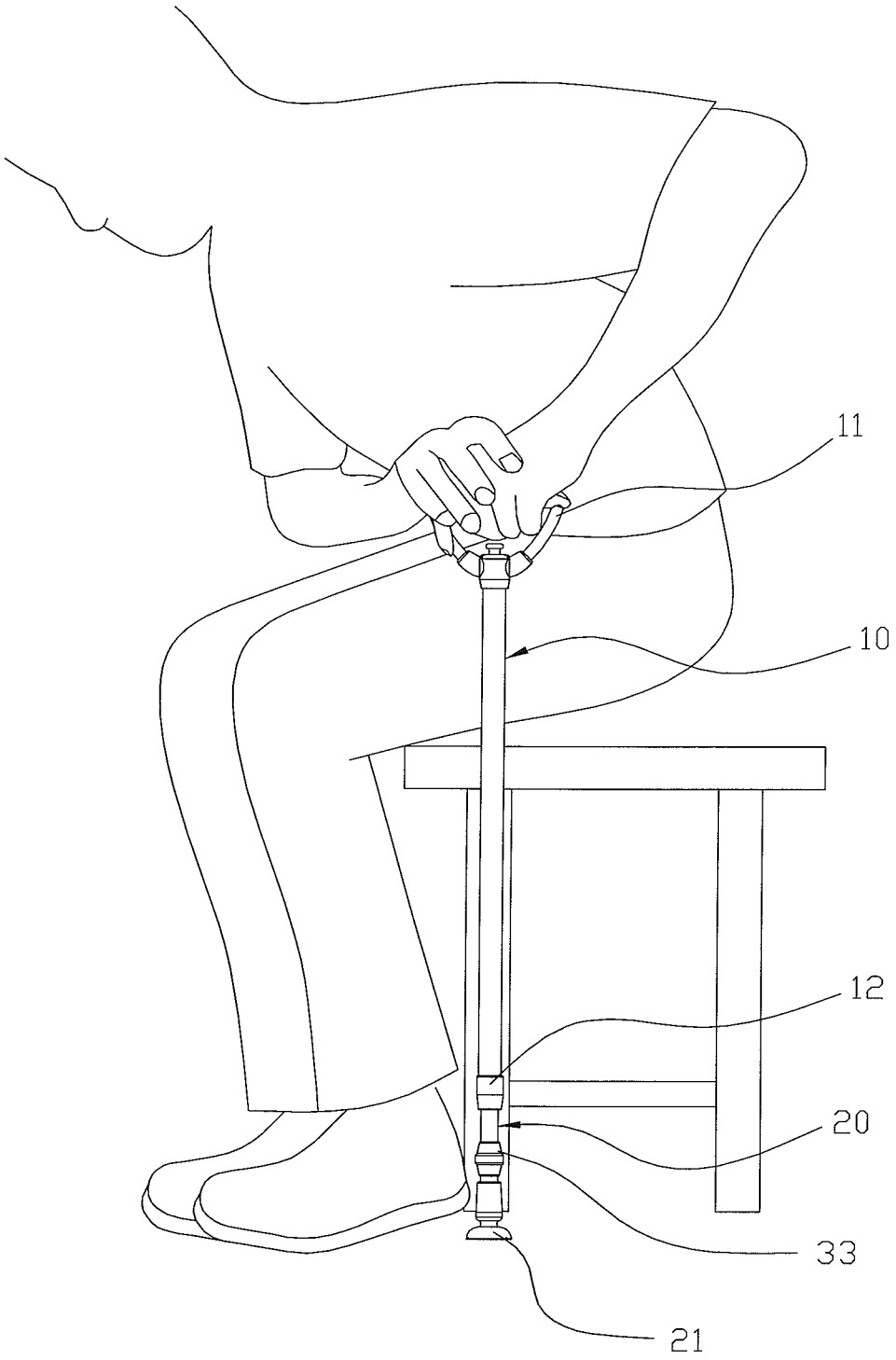
FIG. 12 is also another diagram showing the application of the adjustable positioning structure for the walking stick according to the preferred embodiment of the present invention.
Figure 13:
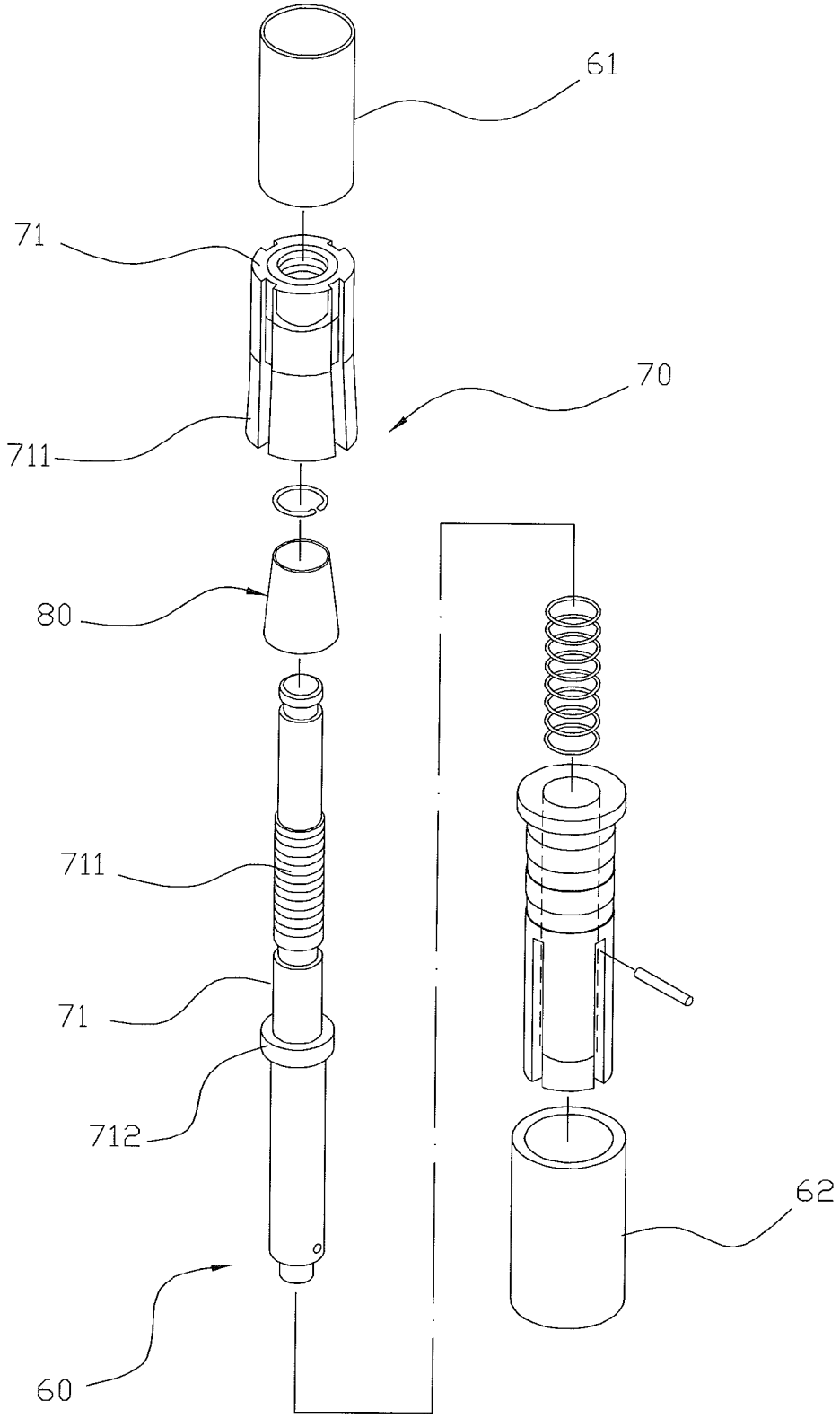
FIG. 13 PRIOR ART
FIG. 13 is a perspective showing the exploded components of a conventional a walking stick with an adjustable positioning structure.
Figure 14:
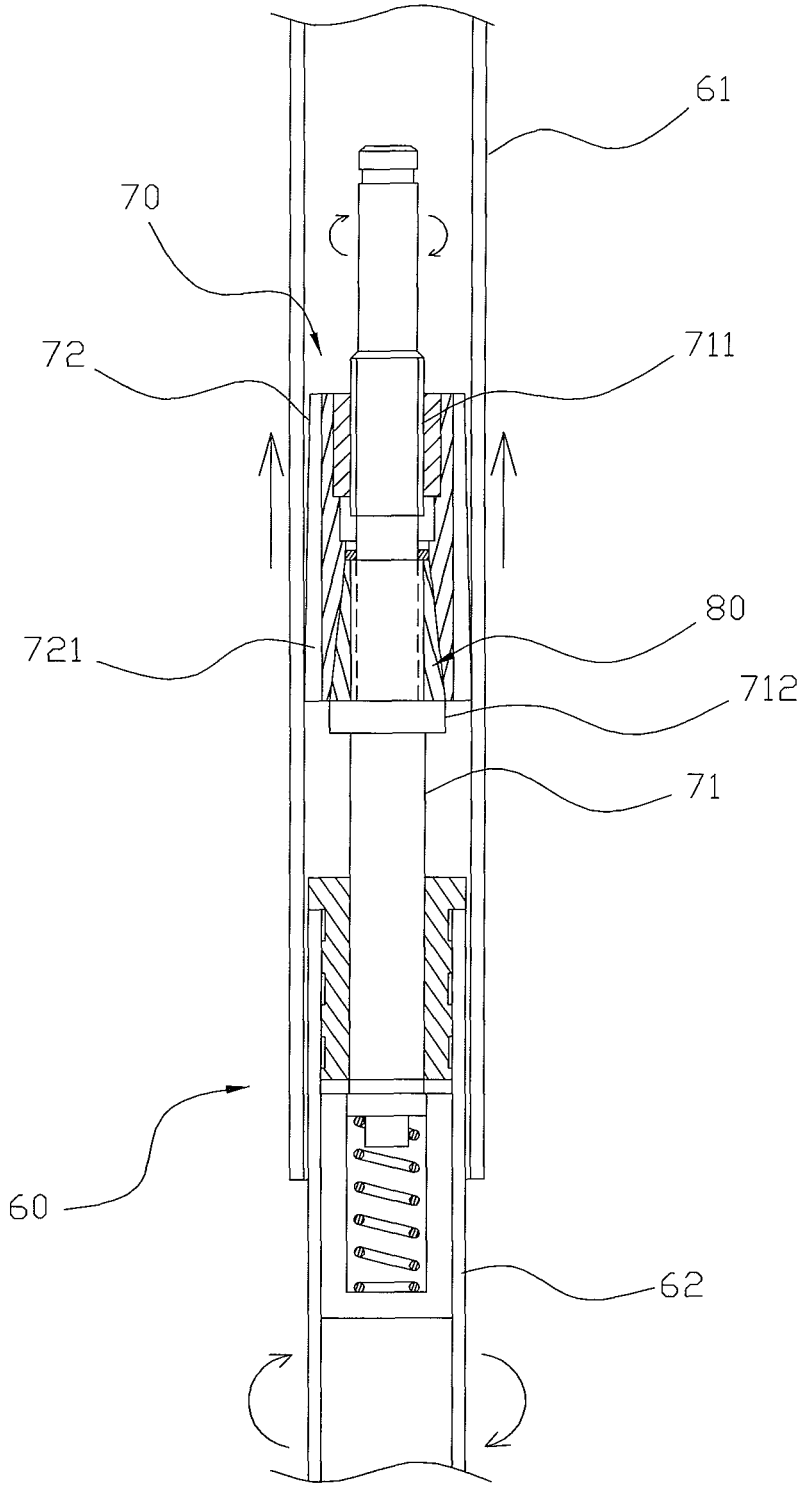
FIG. 14 PRIOR ART
FIG. 14 is a cross sectional showing the operation of the conventional the walking stick with the adjustable positioning structure.

Referring further to FIGS. 6 and 7, when the user holds the gripping head 11 or the outer rod 10 with one hand and grips the inner rod 20 or the ante anti-slip pad 21 with the other hand so as to pull the outer rod 10 and the inner rod 20 outwardly, it is not necessary to rotate a rotating element or to press a press button to extend the walking stick, thereby extending the walking stick easily. After extending the inner rod 20, the inner rod 20 drives the pushing member 40 to remove from the expending member 50, in the meantime, the actuation post 30 and the expending member 50 will not move with the inner rod 20. Furthermore, the conical face 41 of the pushing member 40 does not press the plurality of expansion sheets 53, so the resilient loop 54 does not contact with the first screwing section 14 of the outer rod 10, thus extending the outer rod 10 and the inner rod 20 smoothly. Also, the spring 44 pushes the actuation post 30 so that the expending member 50 presses the pushing member 40 to position an extending length of the outer rod 10 and the inner rod 20. As shown in FIG. 8, the walking stick is extended to support the user to step down the stairs. As desiring to retract the walking stick, as illustrated in FIGS. 9 and 10, the user holds the gripping head 11 or the outer rod 10 with one hand and grips the inner rod 20 with the other hand. Moreover, the user also clamps the holding sheath 33 with two fingers and pushes the holding sheath 33 toward the griping head 11, such that the bolt 34 is driven by the holding sheath 33 to move along the slot 23 of the inner rod 20, and the bushing 32 drives the actuation post 30 to move toward the griping head 11 so that the spring 44 is pressed by the actuation post 30, and the plurality of expansion sheets 53 of the expending member 50 move away from the conical face 41 of the pushing member 40, hence the resilient loop 54 does not contact with the first screwing section 14 of the outer rod 10, and the outer rod 10 does not contact with the inner rod 20, thereby retracting the walking stick quickly. It is preferable that the conical face 41 of the pushing member 40 moves away from the plurality of expansion sheets 53 so that the plurality of expansion sheets 53 and the resilient loop 54 retract inwardly, thereby retracting the walking stick easily. As shown in FIGS. 11 and 12, after the walking stick is retracted, the user can step up to the stairs and stand up by ways of the walking stick. Accordingly, the adjustable positioning structure of the present invention is applied to adjust a length of the walking stick easily and to position the walking stick securely.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An adjustable positioning structure for a walking stick comprising:

an outer rod including a griping head disposed on a first end thereof and a limiting sleeve mounted on a second end thereof, the limiting sleeve having a shoulder formed on an inner wall thereof, and the outer rod also including a first screwing section defined around an inner wall thereof;

an inner rod including an anti-slip pad fixed on a first end thereof and a flange formed around a second end thereof, and the second end of the inner rod being inserted into the outer rod, such that the flange is limited by the shoulder of the limiting sleeve, the inner rod also including a slot passing through a middle section thereof;

an actuation post including a second screwing section defined around a first end thereof and a bushing fitted on a second end thereof, the bushing having a through hole horizontally formed therein, wherein the second screwing section of the actuation post is inserted into the outer rod, and the bushing is inserted into the inner rod; the actuation post also including a holding sheath fitted on the inner rod and a bolt inserted through the holding sheath, the slot of the inner rod and the through hole of the bushing; the actuation post further including a stopping piece fixed on a middle section thereof;

a pushing member including a conical face defined on a first end thereof, a second end inserted into the inner rod, an orifice formed thereon so as to inert the second screwing section of the actuation post, and a spring being biased against the pushing member and the stopping piece;

an expending member including an aperture for fitting the expending member with the first end of the actuation post, a nut for screwing with the second screwing section so as to limit the expending member and the pushing member, a plurality of expansion sheets vertically extending around an outer wall thereof and surrounding around the actuation post, and a resilient loop fitted on a distal end thereof, such that the conical face of the pushing member pushes the plurality of expansion sheets to force the resilient loop, and then the resilient loop is biased against the first screwing section of the outer rod, thereby fixing the outer rod and the inner rod securely.

2. The adjustable positioning structure for the walking stick as claimed in claim 1, wherein the holding sheath has a groove defined thereon so as to fit with a flexible ring, such that the flexible ring covers the bolt.

3. The adjustable positioning structure for the walking stick as claimed in claim 1, wherein a first surrounding tab and a second surrounding tab are arranged around the plurality of expansion sheets and are provided to limit the resilient loop.

4. The adjustable positioning structure for the walking stick as claimed in claim 1, wherein the pushing member includes an annular rib arranged around a middle section thereof and abutting against an opening of the inner tube.

5. The adjustable positioning structure for the walking stick as claimed in claim 1, wherein the outer rod further includes outer threads arranged around an outer wall thereof so as to screw with inner threads which are arranged around the inner wall of the limiting sleeve above the shoulder.

6. The adjustable positioning structure for the walking stick as claimed in claim 1, wherein the bushing has a screw hole vertically arranged therein so as to screw with the actuation post.

* * * * *